US007398956B2

(12) United States Patent
Clark et al.

(10) Patent No.: US 7,398,956 B2
(45) Date of Patent: Jul. 15, 2008

(54) TENSIONING TOOL AND METHOD FOR USING SAME

(76) Inventors: Rick Clark, 929 County Rd. #6, Ironton, OH (US) 45638; Edgel Terry, 1115 Shady La., Rome City, IN (US) 46784

( * ) Notice: Subject to any disclaimer, the term of this patent is extended or adjusted under 35 U.S.C. 154(b) by 0 days.

(21) Appl. No.: 11/619,886

(22) Filed: Jan. 4, 2007

(65) Prior Publication Data

US 2007/0187660 A1 Aug. 16, 2007

Related U.S. Application Data

(60) Provisional application No. 60/756,262, filed on Jan. 4, 2006.

(51) Int. Cl.
*B21F 9/00* (2006.01)

(52) U.S. Cl. ..... 254/248; 81/302; 81/304

(58) Field of Classification Search ..... 254/248, 254/249, 243, 251; 81/300, 302, 303, 304
See application file for complete search history.

(56) References Cited

U.S. PATENT DOCUMENTS 2,595,989 A * 5/1952 Smeltz ..... 43/53.5
2,643,565 A * 6/1953 Mount ..... 81/302
2,650,735 A * 9/1953 Redmond ..... 72/392
2,840,082 A * 6/1958 Salvatore ..... 606/140
3,540,106 A * 11/1970 Goldman ..... 29/268
3,647,186 A * 3/1972 Hartman ..... 254/248
4,181,046 A * 1/1980 Lamb ..... 81/487
4,907,477 A * 3/1990 Farber ..... 81/302
5,458,029 A * 10/1995 Walsky ..... 81/302
5,988,595 A * 11/1999 DeVincent ..... 254/243
6,378,403 B1 * 4/2002 Bates et al. ..... 81/302
6,752,042 B1 * 6/2004 Dawson ..... 81/3.55
7,032,479 B1 * 4/2006 Wang ..... 81/302
7,055,413 B1 * 6/2006 Wang ..... 81/302

* cited by examiner

*Primary Examiner*—Emmanuel M Marcelo
(74) *Attorney, Agent, or Firm*—Ashley Law Firm P.C.

(57) ABSTRACT

A tensioning tool for applying tension to string-like material includes a first member having a first handle section and a first engaging section opposite the handle section facing a first direction for receiving and engaging a first strand. A second member is pivotally connected to the first member and has a second handle section and a second engaging section opposite the second handle section. The second engaging section faces a second direction opposite the first direction for receiving and engaging a second strand, and moving the handle sections of the first and second members towards each other urges the first and second engaging sections apart. The first strand can be attached to the second strand so that when the first and second handle sections are moved toward each other the first and second engaging sections move away from each other thereby tensioning the first strand.

14 Claims, 6 Drawing Sheets

TENSIONING TOOL AND METHOD FOR USING SAME

This application claims priority to U.S. Provisional Application No. 60/756,262, filed Jan. 4, 2006.

TECHNICAL FIELD AND BACKGROUND OF THE INVENTION

The invention relates to a tool that can separate and exert pressure on string-like material, such as strings, fibers, ropes, etc. One embodiment of the invention is particularly useful in forming rope loops on archery bow strings.

Rope loops, also known as string loops, bow loops and/or D-loops, are a common feature on archery bow strings, as they provide several benefits to the archer. Such benefits include the prevention of premature wear on the serving, and the elimination of "nock pinch" when at full draw, which prevents the arrow from falling off the bow string at full draw. The rope loops are typically attached to the bow string via a pair of cinch knots.

While rope loops are popular in archery, forming the rope loop on the bow string with the necessary amount of tension in the cinch knots of the loop without damaging the bow string serving and/or the loop can be difficult. Tapered needle nose pliers and/or screw drivers have been used to pull hard on the rope to tighten the cinch knots. However, such a method has a risk of damaging the bow string.

SUMMARY OF THE INVENTION

Therefore, it is an object of the present invention to provide a tool that can be used in tensioning the cinch knots of a rope loop on a bow string.

It is another object of the present invention to provide a tool that can aid in the formation of a rope loop on a bow string while minimizing damage to the bow string or rope loop.

These and other objects of the invention can be achieved in the preferred embodiments disclosed below by providing a tensioning tool for applying tension to string-like material that includes a first member having a first handle section and a first engaging section opposite the handle section facing a first direction for receiving and engaging a first strand section, and a second member pivotally connected to the first member and having a second handle section and a second engaging section opposite the second handle section. The second engaging section faces a second direction opposite the first direction for receiving and engaging a second strand section, and moving the handle sections of the first and second members towards each other urges the engaging sections of the first and second members apart.

According to another preferred embodiment of the invention, the first engaging section is adapted to receive the first strand section, which is connected to the second strand section, and moving the first and second handle sections of the respective first and second members toward each other urges the engaging sections of the first and second members apart, thereby tensioning the first strand section.

According to another preferred embodiment of the invention, the first engaging section includes a recess facing the first direction for receiving and engaging the first strand section, and the second engaging section includes a plurality of recesses facing the second direction opposite the first direction for receiving and engaging the second strand section.

According to another preferred embodiment of the invention, the first and second members are joined by a pivot member extending through the first and second members.

According to another preferred embodiment of the invention, the first and second handle sections are arcuate.

According to another preferred embodiment of the invention, the recesses are substantially circular.

According to another preferred embodiment of the invention, a tool for use in forming a rope loop on a bow string includes a first member having a first handle section and a first engaging section opposite the first handle section with a first member prong having a recess facing a first direction for receiving and engaging a rope section, and a second member pivotally connected to the first member and having a handle section and an engaging section opposite the handle section having three second member prongs each having a respective recess facing a second direction opposite the first direction for receiving and engaging a bow string, wherein moving the first and second handle sections toward each other urges the first member prong away from the second member prongs.

According to another preferred embodiment of the invention, the three second member prongs are left, middle and right prongs, and the first member prong is aligned with the middle prong of the second member.

According to another preferred embodiment of the invention, the left and middle second member prongs define a first area for positioning a first cinch knot of the rope section on the bow string, and right and middle second member prongs define a second area for positioning a second cinch knot of the rope section on the bow string.

According to another preferred embodiment of the invention, moving the first and second handle sections of the respective first and second members toward each other tightens the first and second cinch knots.

According to another preferred embodiment of the invention, the recess in the first member prong and the recesses in the second member prongs are substantially circular.

According to another preferred embodiment of the invention, the first member prong and the second member prongs each include a rounded edge located at a longitudinal end.

According to another preferred embodiment of the invention, a method of forming a rope loop on a bow string includes providing a tool having a first member with a first handle section and a first prong opposite the first handle section with a recess facing a first direction for receiving and engaging a rope. A second member is pivotally connected to the first member and has a second handle section and second, third and fourth prongs that each have a recess facing a second direction opposite the first direction for receiving and engaging a bow string. The second and third prongs define a first area therebetween and the third and fourth prongs define a second area therebetween. A first end of the rope is tied in a first cinch knot at a desired location on the bow string, and the bow string is positioned in the recesses of the second, third and fourth prongs such that the first cinch knot is positioned in the first area defined by the second and third prongs. The rope is positioned in the recess of the first prong, and a second end of the rope is tied in a second cinch knot on the bow string in the second area defined by the third and fourth prongs. The first and second handle sections are moved toward each other thereby moving the first prong away from the second, third and fourth prongs so that the rope is tensioned and the first and second cinch knots are tightened.

According to another preferred embodiment of the invention, the method of forming a rope loop on a bow string includes the step of cutting an excess length of rope from the second cinch knot.

According to another preferred embodiment of the invention, the second cinch knot is heated, and pressure is applied.

According to another preferred embodiment of the invention, the first and second handle sections are moved away from each other in order to release the rope from the first prong and the bow string from the second, third and fourth prongs.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
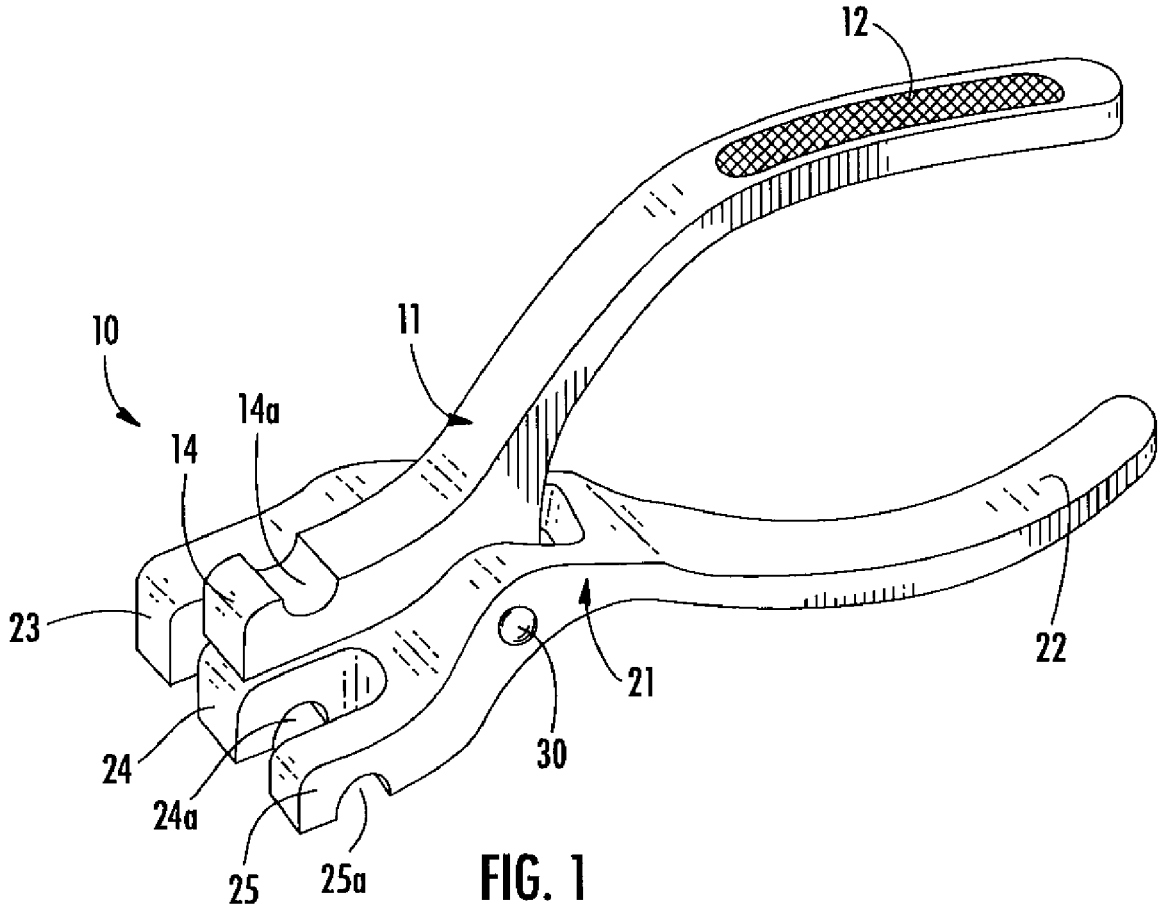
FIG. 1 is a perspective view of a loop set tensioning tool according to a preferred embodiment of the invention.
Figure 3:
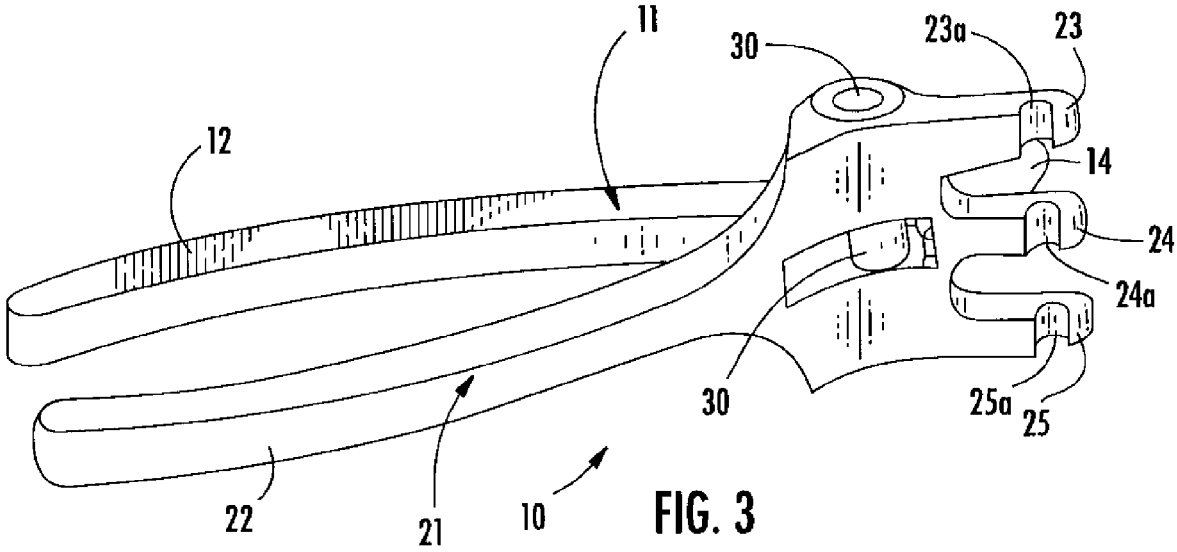
FIG. 3 is another perspective view of the tensioning tool of FIG. 1.
Figure 4:
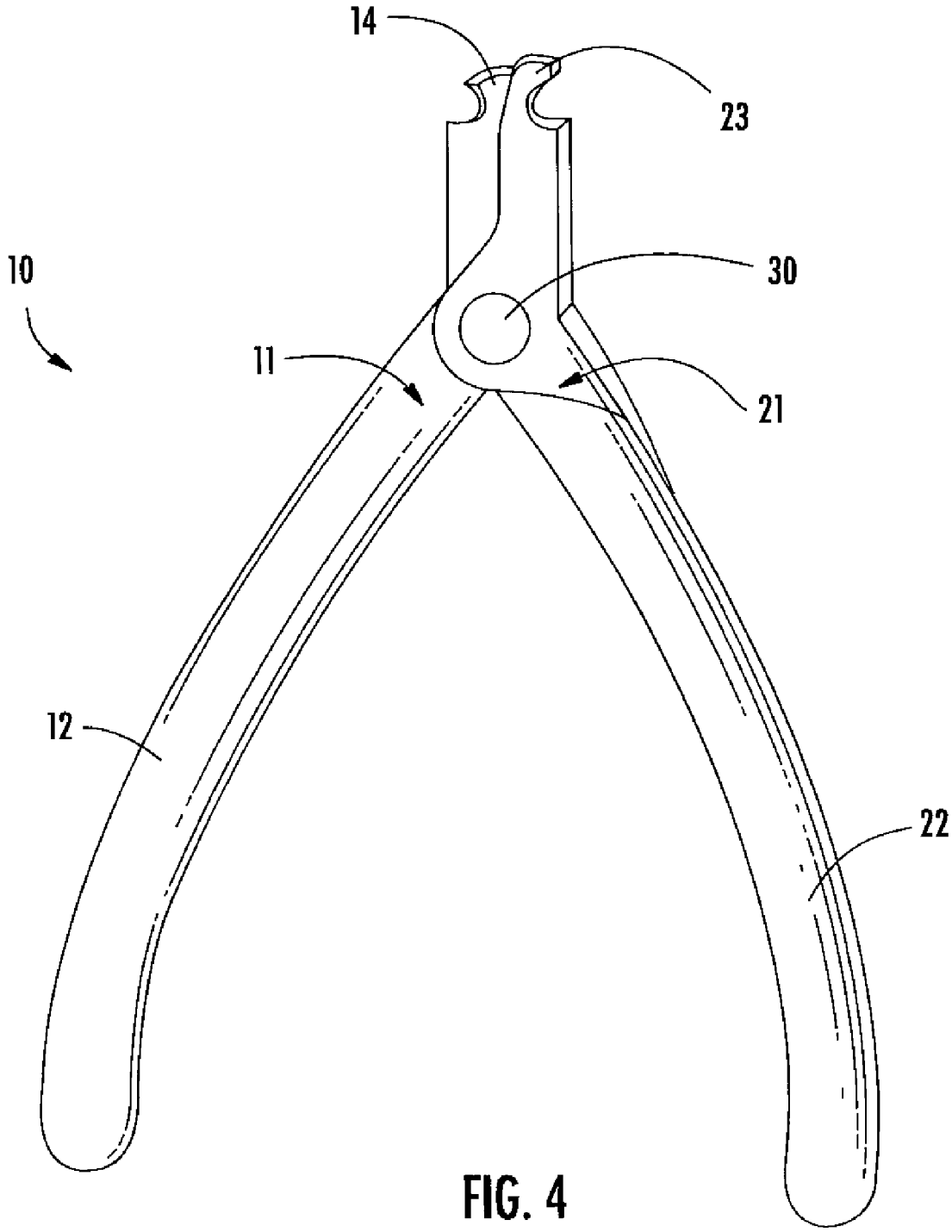
FIG. 4 is a top plan view of the tensioning tool of FIG. 1.
Figure 5:
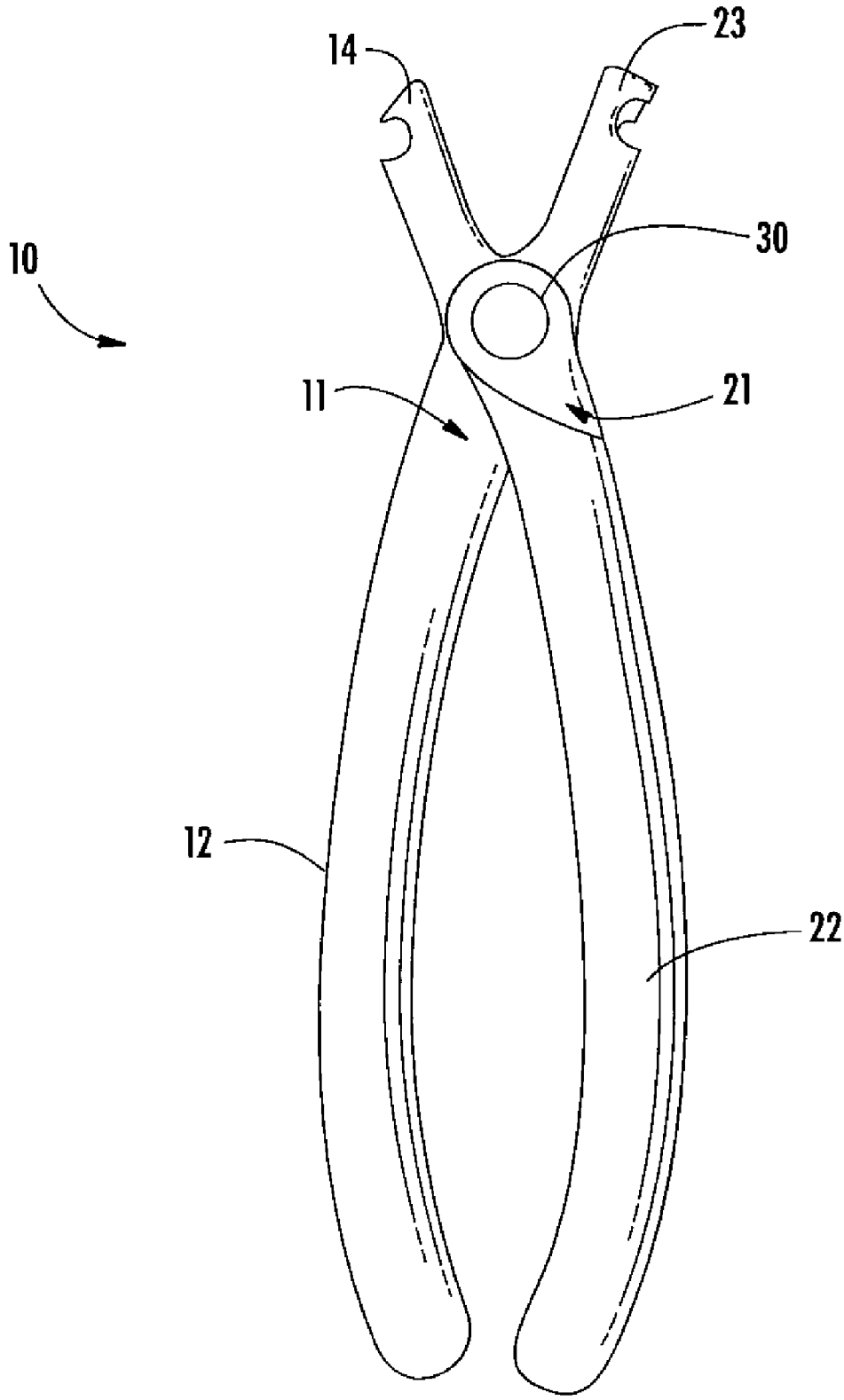
FIG. 5 is another top plan view of the tensioning tool of FIG. 1.

Referring now specifically to the drawings, a loop set tensioning tool according to a preferred embodiment of the invention is illustrated in FIG. 1, and shown generally at reference numeral 10. The loop set tensioning tool 10 includes first and second members 11, 21 pivotally joined at a pivot point 30. The first and second members 11, 21 each include an arcuate handle section 12, 22, respectively. The first member 11 has an engaging section such as an upper prong 14 having a recess 14A facing outwardly from the interior of the tool 10. The second member 21 has an engaging section comprised of three lower prongs 23, 24, 25 having recesses 23A, 24A, 25A, respectively, facing the opposite direction of recess 14A of the upper prong 14. Alternatively, the second member 21 can have fewer or more than three lower prongs 23, 24, 25. Preferably, each of the recesses 14A, 23A, 24A, 25A is in the shape of a half-circle and has a diameter of approximately ⅛ inch. As shown in FIG. 3, the ends of the prongs 14, 23, 24, 25 are rounded. By squeezing the handle sections 12, 22 together, the upper prong 14 and the lower prongs 23, 24, 25 are moved away from each other, as illustrated in FIGS. 4 and 5.

Figure 2:
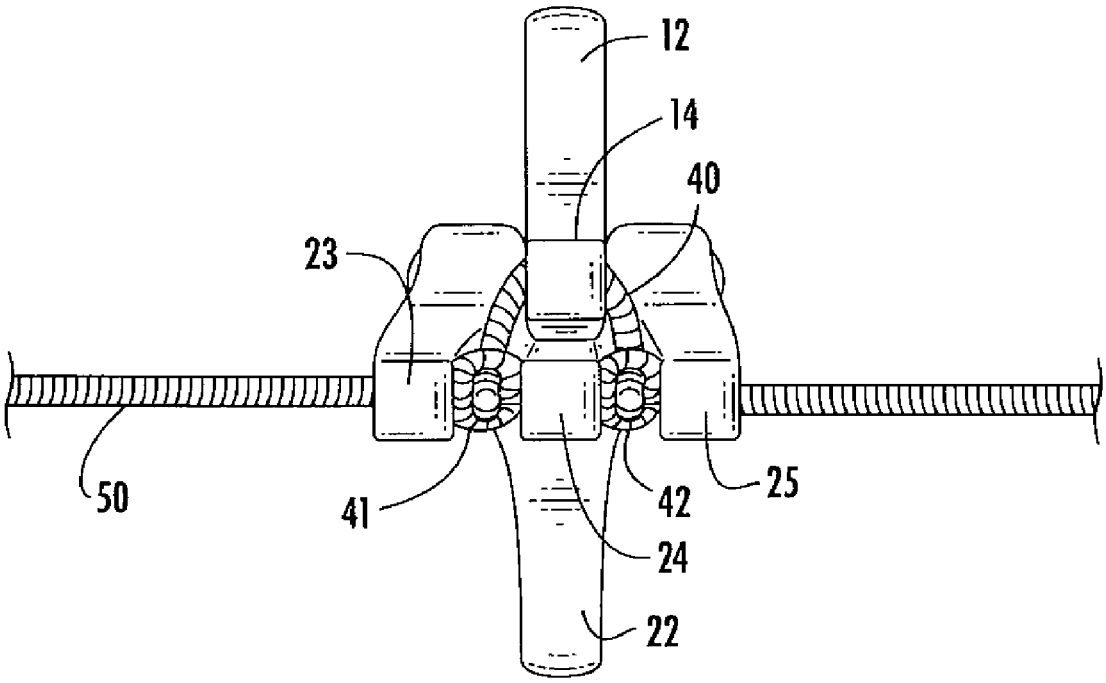
FIG. 2 is a front elevation of the tensioning tool of FIG. 1, illustrating a method of using the tensioning tool according to a preferred embodiment of the invention, showing the tool in a non-tensioning position.
Figure 6:
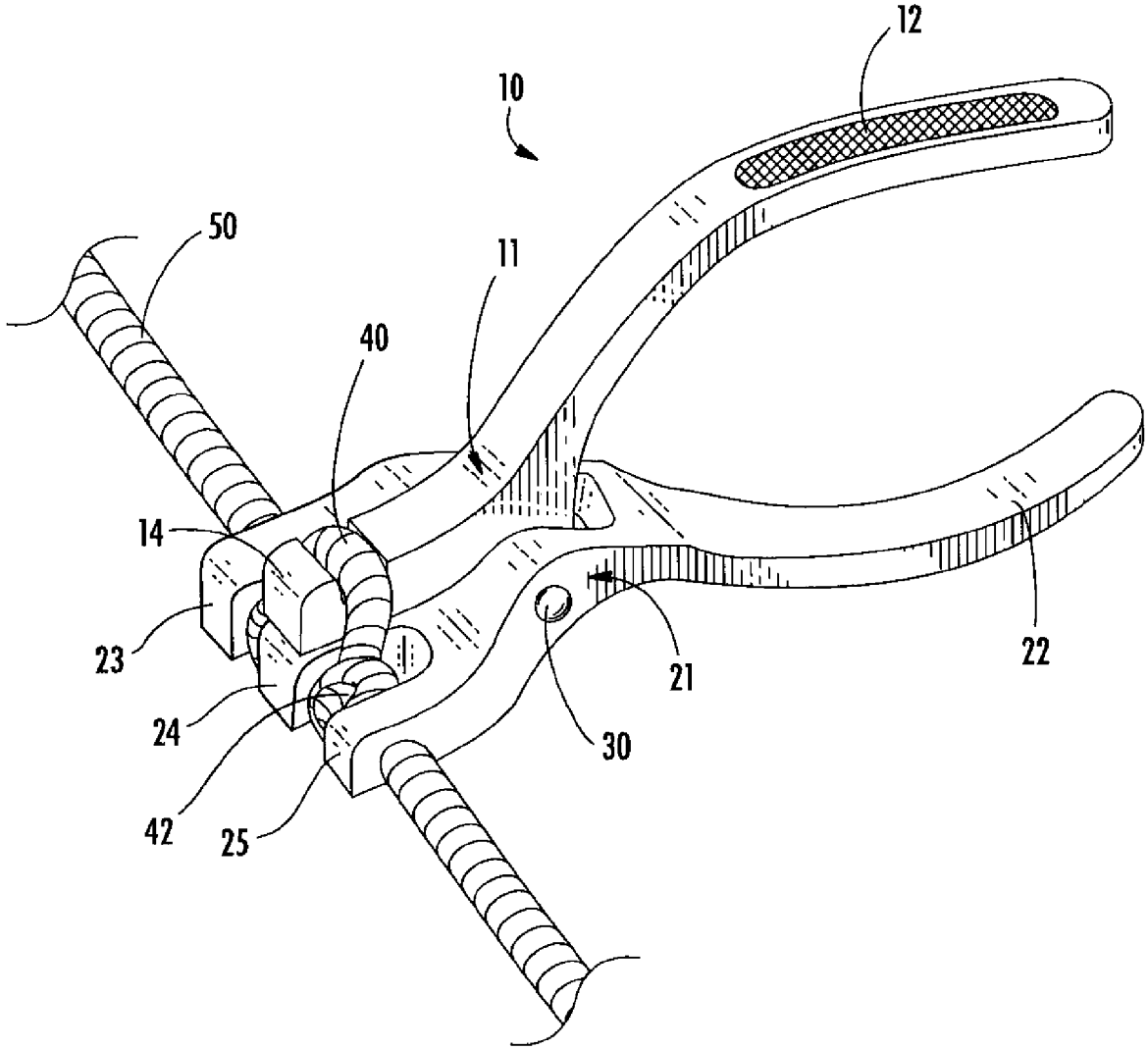
FIG. 6 is an environmental view illustrating a method of using the tensioning tool of FIG. 1 according to a preferred embodiment of the invention.

The tensioning tool 10 can be used to aid in the formation of a rope loop 40 attached to an archery bow string 50 via cinch knots 41, 42, as shown in FIGS. 2 and 6. The terms "rope", "string" and "strand" can be used interchangeably throughout this application, and refer generally to any and all string-like material, including rope, string, cords, fibers, strands, yarn, etc.

In a preferred method of using the tool 10, one end of a small braided rope is connected to the bow string 50 at the desired location by tying the first cinch knot 41. Excess length of rope at the cinch knot 41 can be burned using a lighter or eliminated by other means. The loose end of the rope is then wrapped around the other side of the bow string 50 to form a loop 40 on the string 50. The lower prongs 23, 24, 25 of the tool 10 are placed on the string 50 such that the string 50 sits in the recesses 23A, 24A, 25A. The rope loop 40 is positioned in the recess 14A of the upper prong 14. The loose end of the rope is pulled to tighten the loop 40 on the upper prong 14. The loose end of the rope is then pushed through the space between lower prong 23 and lower prong 24, and brought back into the loop 40. The rope is pulled tight to form the second cinch knot 42. Side cutters can be used to cut the excess length of rope from the second cinch knot 42 down to a length of approximately ⅛ to ¼ inch. The remaining length of rope can then be burned using a lighter. Once the fire burns out, pressure is applied to the cinch knot 42.

At this point, the bow string 50 is securely held by the lower prongs 23, 24, 25, while the rope loop 40 is held within the upper prong 14, as shown in FIG. 2. The first cinch knot 41 is positioned in the space between lower left prong 23 and middle prong 24, and the second cinch knot 42 is positioned between lower middle prong 24 and right prong 25. The curvature of the prongs 14, 23, 24, 25 conform to the shape of the loop 40.

Figure 2A:
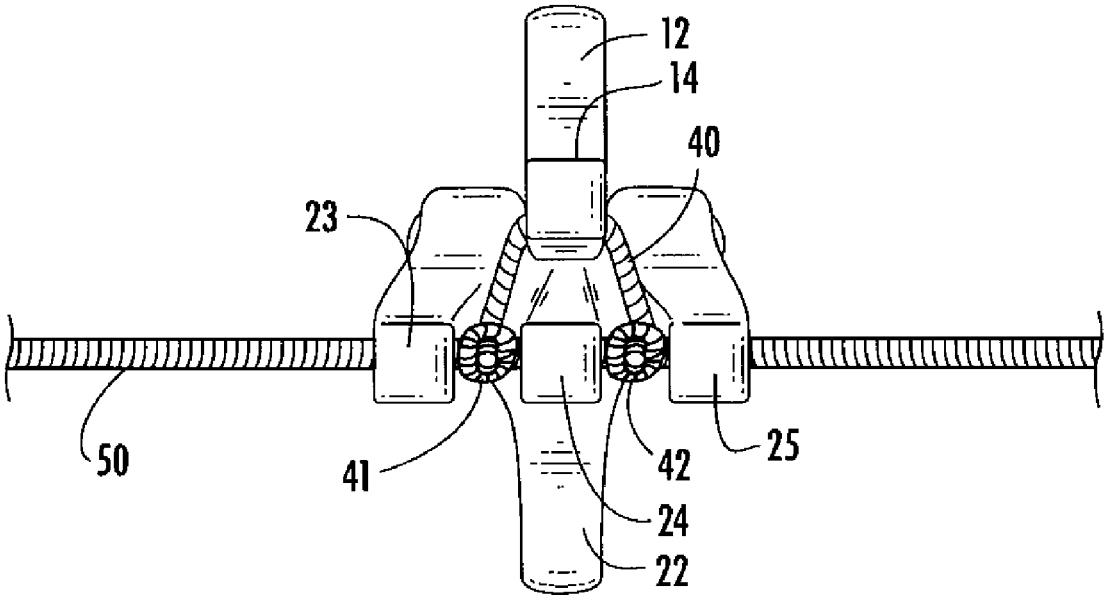
FIG. 2A is another front elevation of the tensioning tool of FIG. 1, illustrating a method of using the tensioning tool according to a preferred embodiment of the invention, showing the tool in a tensioning position.

The handles 12, 22 are squeezed together, and the upper prong 14 moves away from the lower prongs 23, 24, 25, thereby tightening the cinch knots 41, 42 and expanding the size of the loop 40, as shown in FIG. 2A. The tensioning tool 10 can exert approximately 400 to 500 pounds of pressure. The three pressure points on the string 50 exerted by lower prongs 23, 24, 25 allows for the upper prong 14 to tighten the cinch knots 41, 42 without putting an undesired curve, bend or wave in the bow string 50, or damaging the loop 40 or string 50. The user releases the handles 12, 22 to cease exerting pressure and remove the prongs 14, 23, 24, 25 from the rope loop 40 and string 50. The result is a rope loop 40 that is set extremely tight on the bow string 50, without damage to the loop 40 or string 50, as shown in FIG. 2.

A loop set tensioning tool and a method for using same are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

What is claimed is:

1. A tool for use in forming a rope loop on a bow string comprising:

(a) a first member having a first handle section and a first engaging section opposite the first handle section comprising a first member prong having a recess facing a first direction for receiving and engaging a rope section; and (b) a second member pivotally connected to the first member and having a handle section and an engaging section opposite the handle section comprising three second member prongs each having a respective recess facing a second direction opposite the first direction for receiving and engaging a bow string, wherein moving the first and second handle sections toward each other urges the first member prong away from the second member prongs.

2. A tool according to claim 1, wherein the three second member prongs comprise left, middle and right prongs, and wherein the first member prong is aligned with the middle prong of the second member.

3. A tool according to claim 2, wherein the left and middle second member prongs define a first area for positioning a first cinch knot of the rope section on the bow string, and right and middle second member prongs define a second area for positioning a second cinch knot of the rope section on the bow string.

4. A tool according to claim 3, wherein moving the first and second handle sections of the respective first and second members toward each other tightens the first and second cinch knots.

5. A tool according to claim 1, wherein the first and second handle sections are arcuate.

6. A tool according to claim 1, wherein the recess in the first member prong and the recesses in the second member prongs are substantially circular.

7. A tool according to claim 1, wherein the first member prong and the second member prongs each include a rounded edge located at a longitudinal end.

8. A method of forming a rope loop on a bow string comprising:

(a) providing a tool comprising:

(i) a first member having a first handle section and a first prong opposite the first handle section having a recess facing a first direction for receiving and engaging a rope, and (ii) a second member pivotally connected to the first member and having a second handle section and second, third and fourth prongs each having a recess facing a second direction opposite the first direction for receiving and engaging a bow string, the second and third prongs defining a first area therebetween and the third and fourth prongs defining a second area therebetween;

(b) tying a first end of the rope in a first cinch knot at a desired location on the bow string;

(c) positioning the bow string in the recesses of the second, third and fourth prongs such that the first cinch knot is positioned in the first area defined by the second and third prongs;

(d) positioning the rope in the recess of the first prong;

(e) tying a second end of the rope in a second cinch knot on the bow string in the second area defined by the third and fourth prongs; and (f) moving the first and second handle sections toward each other to move the first prong away from the second, third and fourth prongs whereby the rope is tensioned and the first and second cinch knots are tightened.

9. A method according to claim 8, further comprising the step of cutting an excess length of rope from the second cinch knot.

10. A method according to claim 8, further comprising the step of heating the second cinch knot.

11. A method according to claim 10, further comprising the step of applying pressure to the second cinch knot.

12. A method according to claim 8, wherein the first and second handle sections are arcuate.

13. A method according to claim 8, wherein the recesses in the first, second, third and fourth prongs are substantially circular.

14. A method according to claim 8, further comprising the step of moving the first and second handle sections away from each other to release the rope from the first prong and the bow string from the second, third and fourth prongs.

* * * * *